US007118384B2

(12) United States Patent
Alvarez

(10) Patent No.: US 7,118,384 B2
(45) Date of Patent: Oct. 10, 2006

(54) MODEL TRAIN COUPLING WITH INTEGRATED ELECTRICAL CONTACT

(75) Inventor: Joseph Alvarez, Avoca, MI (US)

(73) Assignee: Lionel L.L.C., Chesterfield, MI (US)

( * ) Notice: Subject to any disclaimer, the term of this patent is extended or adjusted under 35 U.S.C. 154(b) by 0 days.

(21) Appl. No.: 11/106,946

(22) Filed: Apr. 15, 2005

(65) Prior Publication Data

US 2005/0255721 A1 Nov. 17, 2005

Related U.S. Application Data

(63) Continuation-in-part of application No. 10/802,226, filed on Mar. 17, 2004, now Pat. No. 6,942,492.

(60) Provisional application No. 60/455,180, filed on Mar. 17, 2003.

(51) Int. Cl.
*H01R 12/00* (2006.01)

(52) U.S. Cl. ..... 439/65; 439/34; 439/289

(58) Field of Classification Search ..... 439/65, 439/34, 289, 292
See application file for complete search history.

(56) References Cited

U.S. PATENT DOCUMENTS 1,602,297 A * 10/1926 Becker ..... 191/49
2,223,905 A * 12/1940 Beyer et al. ..... 213/212

* cited by examiner

*Primary Examiner*—Truc Nguyen
(74) *Attorney, Agent, or Firm*—O'Melveny & Myers LLP

(57) ABSTRACT

A coupling for connecting model cars of a model train includes an integrated resilient contact supported by a first coupling member disposed against a mating electrical connector of a second coupling member. The first and second coupling members are configured to bear mechanical tension and compression, while permitting vertical movement of one coupling relative to the other. The resilient contact and mating contact are configured to maintain an electrical connection during relative vertical movement of the coupling members. Using the coupling, separate cars of a model train may be placed in electrical communication with one another without requiring a separate electrical connector. A wireless connection may also be made through the coupling.

19 Claims, 6 Drawing Sheets

MODEL TRAIN COUPLING WITH INTEGRATED ELECTRICAL CONTACT

RELATED APPLICATION DATA

This application is a continuation-in-part of application Ser. No. 10/802,226, filed Mar. 17, 2004, now U.S. Pat. No. 6,942,492 which claims priority pursuant to 35 U.S.C. § 119(e) to Provisional Application Ser. No. 60/455,180, filed Mar. 17, 2003. Both of the foregoing applications are specifically incorporated herein, in their entirety, by reference.

BACKGROUND OF THE INVENTION

1. Field of the Invention

The present invention relates to electric powered models, for example, model trains, and more particularly to a coupling for mechanically and electrically coupling two or more model cars together.

2. Description of Related Art

It is known to provide an electric powered model vehicle, such as a model train, that comprises a plurality of cars coupled together by mechanical couplings. Such mechanical couplings may be designed to readily couple and decouple different cars or locomotives of a train assembly. A model train hobbyist may thus readily construct a variety of different trains using various interchangeable model locomotives and cars.

Locomotives and cars often contain various controllers, accessories, and engines that should be maintained in an electrically connected state for proper operation. Accordingly, it is also known to couple electrical signals between different cars of a model train assembly, for example between a locomotive and a tender, using wires from each car terminating in complementary connectors.

Notwithstanding their advantages, existing mechanical and electrical coupling arrangements are subject to certain limitations. For instance, existing arrangements require separate mechanical and electrical connections to couple a pair of train cars together. That is, separate "hardwire" connections are used to electrically connect the circuit(s) of the train cars so that signals such as power, ground and other similar electric pulses may be transmitted between cars. Such connections may be tedious to make, and may undesirably delay the process of coupling and decoupling cars of a train assembly. More convenient electrical connectors, however, may appear out-of-place or not to scale with other elements of a model train. For example, a plug-and-socket connector as used on actual train cars may be difficult to scale to a model size while providing adequate strength, manipulability and functionality.

In addition, the characteristics of model train couplings have heretofore prevented maintaining a reliable electrical connection, except via a hardwired connection. Relative movement between coupling pieces may disrupt electrical contact connections between the couplings as the train moves around a model track. For example, adjacent cars of a model train may move vertically with respect to one another as a train moves across a track, due to changes or unevenness in track elevation. To prevent undesired downward or upward forces through the coupling, many model train couplings are designed to permit relative vertical movement without decoupling. Likewise, many couplings are designed to permit a degree of slack in horizontal movement, that is, to permit relative horizontal movement within a limited range. Couplings are also designed to be readily coupled and decoupled. Such requirements for relative freedom of movement and ease of coupling and decoupling have heretofore militated against the maintenance of an electrical contact connection through the coupling itself.

Accordingly, a need exists for a coupling that overcomes these and other limitations of the prior art.

SUMMARY OF THE INVENTION

The invention provides a coupling with an integrated electrical contact for coupling cars of a model train together. Using a coupling according to the invention, a hobbyist may avoid a need for extra hardwire connections to transmit signals, such as power, ground or other electrical signals between two or more electric model train cars, and more conveniently and reliably establish such connections.

In an embodiment of the invention, a resilient conductive contact supported by a coupling member on a first train car (such as a locomotive or a tender) makes contact with an electrical contact of a coupling for an adjacent train car, thereby completing an electrical connection between the cars. Mechanical coupling members establish a mechanical connection between the cars, while the integrated contacts maintain the electrical connection as the train moves around the track. Conductive elements of the coupling may serve as both electrical conductors and mechanical components.

In one embodiment, a locomotive obtains an electrical connection to ground through this coupling to an adjacent train car, which in turn connects to ground using its rolling wheel contacts with a track rail. This arrangement may improve electrical reliability during operation, especially for locomotives configured for minimal connections to the ground track rail, for example, a locomotive having rubberized wheels for improved traction. In the alternative, or in addition, the flexible connector may include an aperture to allow IR communication between the locomotive and the train car. Electrical signals other than ground may also be communicated by the inventive connection, including but not limited to power and/or control signals. The coupling may be used in AC or DC powered systems.

Accordingly, an integrated coupling incorporating a resilient electrical contact with mechanical coupling elements is disclosed. The integrated coupling includes a first and a second coupling member associated with a first and a second model train car, respectively. The second coupling member is configured for engagement with the first coupling member. The integrated coupling further comprises a resilient electrical contact supported by the first coupling member and disposed to make an electrical connection to an electrical contact of the second coupling member when the coupling members are engaged together. The resilient electrical contact is configured to maintain an electrical connection during relative vertical and horizontal movement of the first and second coupling members.

The coupling as described herein allows two-way communication between two or more train cars without the need of secondary physical connectors, wires, or other devices to couple the cars together. A coupling according to the invention may be used for a number of purposes, such as, for example, between two intelligent cars allowing communication or control of physical devices such as, for example, lights, sound and movement. For example, a locomotive may receive a signal to trigger the lights or sounds associated with the train cars. The locomotive may transmit a signal to a lighting circuit or sound circuit on a tender car coupled to the locomotive by way of an integrated mechanical/electrical coupling, thereby causing the activation or deactivation of lights or sound of the tender car.

Similarly, an integrated mechanical/electrical coupling may be used to transfer some or all of the electrical power or a connection to electrical ground as needed to operate model trains. For example, a locomotive may receive power or ground via a rolling connection to a powered rail of a model train track, and distribute power as desired via one or more integrated mechanical/electrical couplings to run motors or other electrical devices located on any train car coupled (directly or indirectly) to the locomotive. Conversely, power or ground from a trailing car or cars may be provided to a locomotive, to enhance the reliability and stability of the locomotive's power supply. One of ordinary skill may develop a number of other applications for this inventive coupler.

A more complete understanding of the model train coupling with an integrated electrical contact will be afforded to those skilled in the art, as well as a realization of additional advantages and objects thereof, by a consideration of the following detailed description of the preferred embodiment. Reference will be made to the appended sheets of drawings which will first be described briefly.

DETAILED DESCRIPTION OF THE PREFERRED EMBODIMENT

Figure 1A:
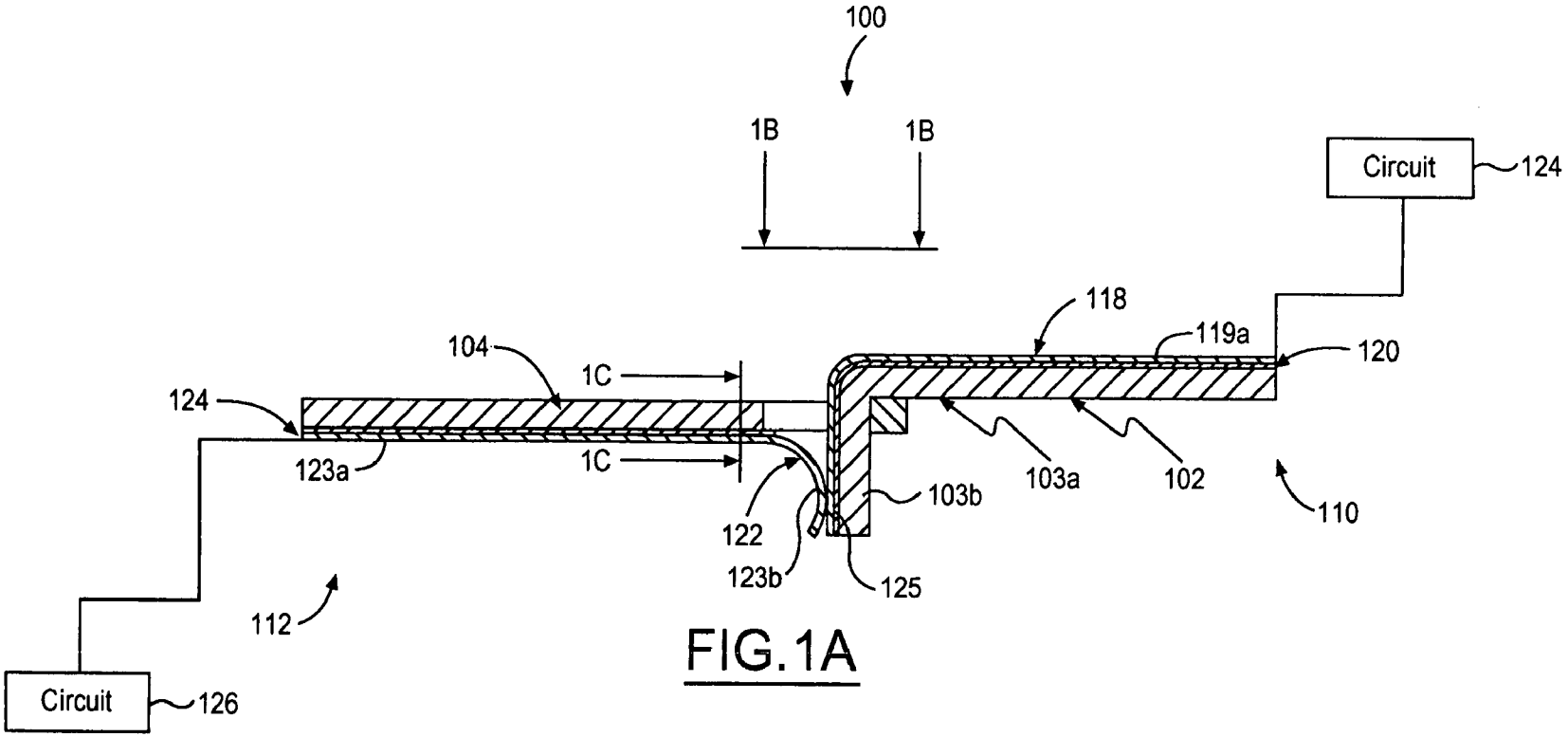
FIG. 1A is a side view of an exemplary embodiment of an integrated mechanical/electrical coupling in accordance with the present invention.

The present invention provides a coupling for connecting model cars together with an integrated flexible contact. In the detailed description that follows, like reference numerals are used to denote like elements appearing in one or more of the figures.

FIG. 1A shows a first exemplary embodiment of an integrated mechanical/electrical coupling 100. Coupling 100 provides an electrical and mechanical connection between a first model train car, such as a locomotive car 110, and a second model train car, such as a tender car 112. It should be noted that while coupling 100 may be used to couple a locomotive and tender together, it is not limited to this configuration. Coupling 100 may be used to couple any number of various cars together, for example, model locomotives, tenders, freight cars, passenger cars, cabooses, and so forth. FIG. 1A further shows a first coupling member 102 associated with locomotive 110, and a second coupling member 104 associated with tender car 112. First and second coupling members 102 and 104 shown in FIG. 1A may be of the drawbar type, and may comprise any suitable structural material, for example, various metals or metal alloys, or plastic materials.

First coupling member 102 includes a horizontal portion 103*a* having a top and a bottom side, and a vertical portion 103*b* having an inner and an outer side. Vertical portion 103*b* may be located at a distal end of horizontal portion 103*a*, and may be configured to be perpendicular therewith so as to form a generally J-shaped drawbar in a portion proximal to coupling member 104. In an exemplary embodiment, first coupling member 102 further includes an electrically conductive material 118 disposed on the upper and the outer sides of portions 103*a* and 103*b*, respectively. Material 118 may comprise a first electrical conductor 119*a* connected to an electrical contact 119*b* and extending to a distal portion of the first coupling member for connecting to a circuit 124 of car 110. Material 118 may comprise a layer of sheet material, or may comprise conductive wires, rods, traces, in portion 119*a*, for connecting contact 119*b* to circuit 124. In an embodiment of the invention, material 118 comprises a sheet of metallic material contoured to conform to coupling member 102. Optionally, material 118 and coupling member 102 may be integrated as a single piece serving both as a mechanical drawbar and an electrical contact and connector.

First coupling member 102 may further include an electrically insulating material 120 disposed between conductive layer 118 and the upper and outer sides of coupling member 102, as shown. If drawbars 102 and 104 are made of a non-conductive material, or if the coupling 100 is used for a connection to ground, insulating layer 120 may not be necessary. Electrically conductive material 118 and electrically insulating material 120 may comprise conventional materials as known in the art. For example, material 118 may comprise copper or its alloys and material 120 may comprise an organic polymer material or any suitable electrical insulator.

Figure 1B:
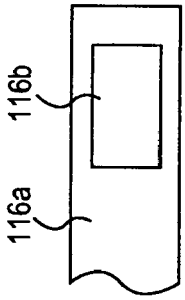
FIG. 1B is a top view of a portion of the integrated mechanical/electrical coupling of FIG. 1 along the lines 1B—1B in FIG. 1.

Second coupling member 104 may comprise a horizontal portion 116*a* having a top and a bottom side, and an aperture 116*b* on an end portion proximal to coupling member 102 (more clearly shown in FIG. 1B). Portion 103*b* and aperture 116*b* may be configured in a complementary manner in both size and shape so that proximal portion 103*b* may be disposed in aperture 116*b*, as shown in FIG. 1A. Other shapes for engaging proximal portions of the respective coupling members may also be suitable. In general, a proximal portion of coupling member 102 should engage with member 104 so as to permit a degree of relative vertical movement between the coupling members, to reduce stress on the coupling from changes or unevenness in track elevation as the model train moves around the track. The coupling members may also engage so as to permit a small amount of horizontal free play between them.

In an exemplary embodiment, second coupling member 104 further includes an electrically conductive material 122 supported by coupling member 104. Conductive material 122 comprises a generally elongated portion 123*a* connected to an extending resilient contact 123*b*. Portion 123*a* may comprise an electrical conductor connected to resilient electrical contact 123*b* and extending to a distal portion of the second coupling member 104 for connecting to a circuit 126 of car 112. Conductive layer 122 may comprise a phosphor bronze material for its suitability with respect to springiness, and ability for elastic deformation (i.e., that will retain its shape). Second coupling member 104 may still further include a layer of electrically insulating material 124 disposed between conductive material 122 and the bottom side of second coupling member 104, as shown.

Resilient contact 123*b* may comprise a cylindrical segment shape in a cantilevered configuration, as shown. This configuration should facilitate insertion and removal of J-bar 103*b* with respect to aperture 116*b*, and should also maintain contact with electrical contact 119*b* during relative vertical or horizontal motion of coupling pieces 102, 104. More particularly, the resilient electrical contact 123*b* may be configured to remain resiliently biased against the electrical contact 119*b* while sliding vertically during the permitted vertical movement. Contact 123*b* may comprise at least one finger curved in a substantially vertical plane to define an intermediate portion for contacting the adjoining contact 119*b* between a base of the finger and its distal end, as shown. Advantageously, the curved shape of contact 123*b* may reduce stress concentration in material 122 from contact forces. Many other configurations and shapes may also be suitable for resilient contact 123*b*, for example, cantilever, two-point supported, or three-point supported mounts, and various different shapes such as straight, serpentine, helical, spiral, disk, and so forth.

Flexible resilient contact 123*b* of conductive layer 122 may project into aperture 116*b* and be biased against contact 119*b* such that electrical contact is made at any suitable point 125 between the layers of electrically conducting material 118 and 122. Contact 119*b* may be substantially rigid (non-resilient), or may comprise a resilient member or portion. Connection point 125 may provide electrical connectivity between a circuit 124 (e.g., a ground input for a motor drive or motor input terminal) and a circuit 126 (e.g., a coupling to the ground track rail such as a truck axle via a conductive wheel). Other power and/or control signals may be passed via coupling 100 for various electronic circuits (e.g., circuits 124 and 126). Accordingly, when first and second coupling members 102 and 104 are engaged, train cars 110 and 112 (e.g., locomotive and tender) may be both mechanically and electrically coupled together using one single coupling without any additional hardwire connections or additional connectors.

Figure 1C:
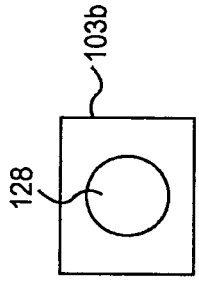
FIG. 1C is a front view of a portion of the integrated mechanical/electrical coupling of FIG. 1 along the lines 1C—1C in FIG. 1.

With reference to FIGS. 1A and 1C, first coupling member 102, and portion 103*b* in particular, may be provided with a second through aperture 128 therein for use in an alternative embodiment. Aperture 128 may be configured to allow transmission of infrared (IR) signals from a wireless transmitter (not shown) associated with car 110 to a wireless receiver (not shown) associated with car 112. Messages may be communicated using any suitable IR or RF transmitter/receiver, as known in the art. Other methods of wireless communication may also be suitable, for example, using a visible light frequency or microwave frequency.

Figures 2, 3, 4:
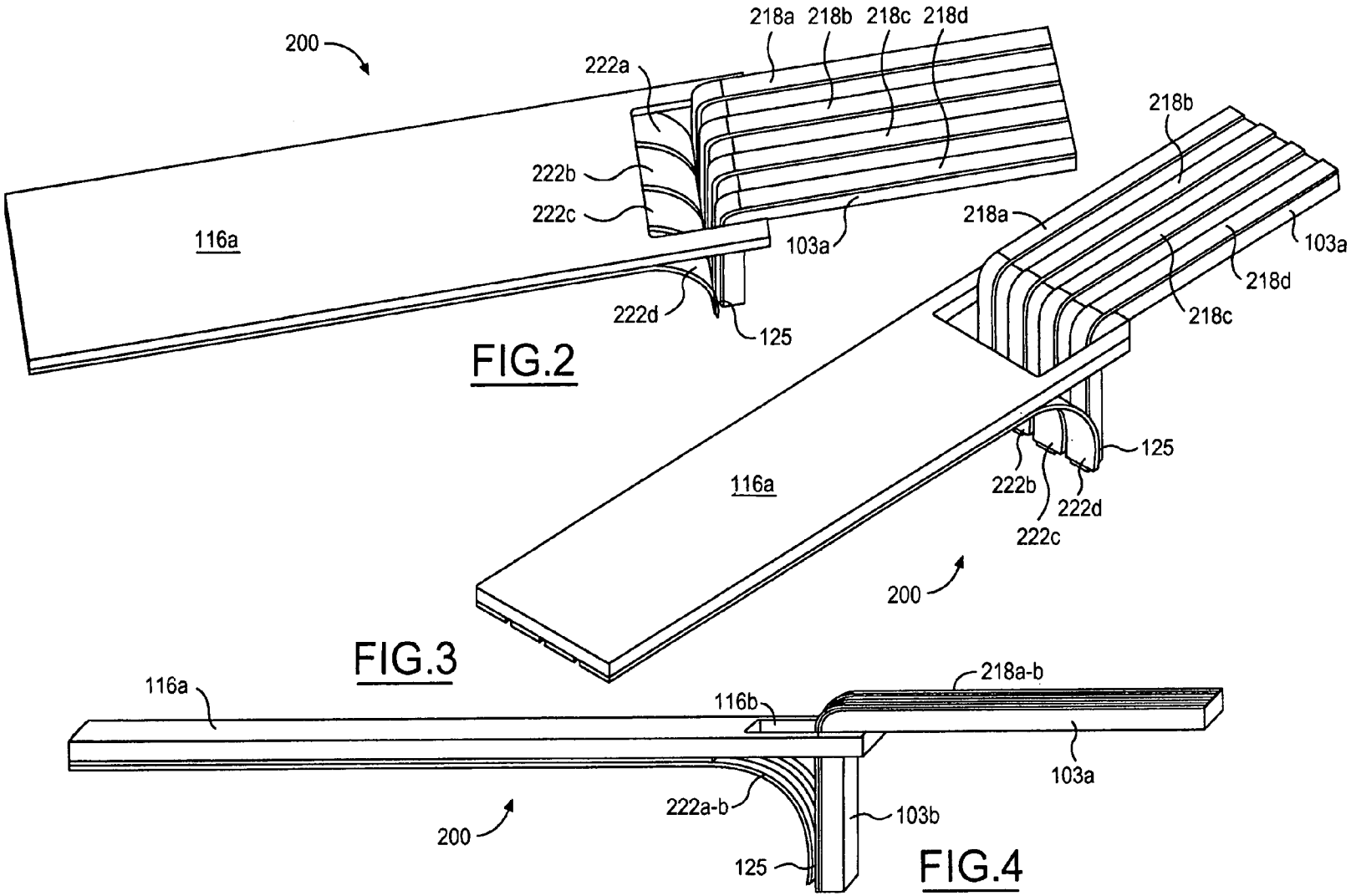
FIG. 2 is a first perspective view of an integrated mechanical/electrical coupling of according to an alternative embodiment of the invention.
FIG. 3 is a second perspective view of the integrated mechanical/electrical coupling of FIG. 2.
FIG. 4 is a third perspective view of the integrated mechanical/electrical coupling of FIG. 2.

With reference to FIGS. 2–4, a coupling 200 similar to coupling 100 described above may be configured so that conductive materials 118 and 122 each comprise a plurality of separate parallel conductive elements. For example, FIGS. 2–4 show a four-conductor configuration. Conductive material 118 and 122 may be configured with any number of conducting elements. In the illustrated embodiment, first coupling member 102 supports four conducting elements 218*a*, 218*b*, 218*c*, and 218*d* configured as vertically-oriented fingers. Second coupling element 104 includes a corresponding four conducting elements 222*a*, 222*b*, 222*c*, and 222*d* configured as contact pads elongated in a vertical direction. When first and second coupling members 102 and 104 are engaged, conductive portions 218*a*, 218*b*, 218*c*, and 218*d* engage portions 222*a*, 222*b*, 222*c*, and 222*d*, respectively. Thereby, four separate circuits may be connected between adjoined cars. Any other desired number of connections may be made in a similar fashion.

Figure 5:
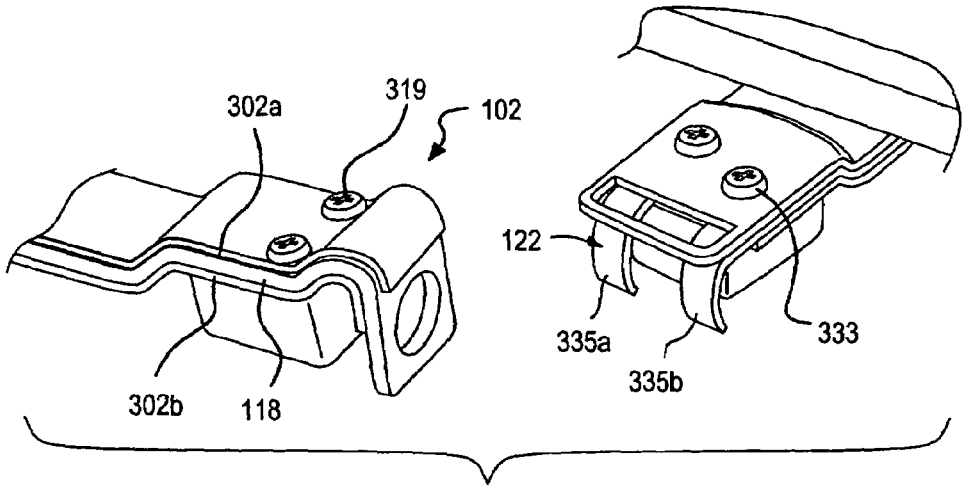
FIG. 5 is a perspective view of an alternative embodiment of an integrated mechanical/electrical coupling in accordance with the present invention.
Figure 6:
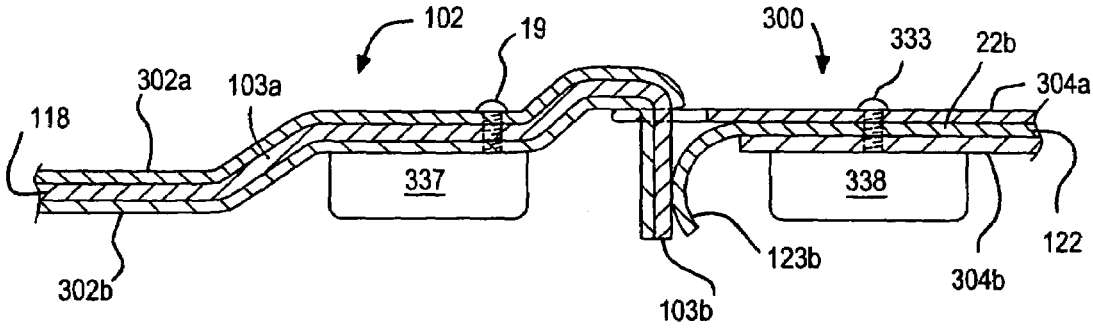
FIG. 6 is cross-sectional view of an alternative embodiment of the integrated mechanical/electrical coupling shown in FIG. 5.

FIGS. 5–6 show an alternative coupling 300 that is similar to coupling 100 described above in most respects, but differs in a few particulars as described below. Coupling 300 illustrates that conductive material 118 may also be disposed within the structure of first coupling member 102, instead of on the surface of coupling member 102 as shown for coupling 100. Portion 103*a* of first coupling member 102 may comprise a pair (or any other desired number) of structural members 302*a*, 302*b* adjacent to conductive material 118. Layers of insulating material (not shown) may be disposed between structural members 302*a*, 302*b* and conductive material 118, if desired. Structural members 302*a*, 302*b* and conductive material 118 may be attached using any suitable method, such as fasteners 319. Portion 103*a* of coupling member 102 may comprise a metallic material or any other suitable material, for example, plastic. Portion 103*b* may be configured with conductive material 118 exposed towards opposing resilient contact 123*b* of coupling member 104.

Coupling member 104 may likewise comprise a conductor 122 with a resilient portion 123*b* proximal to contact 103*b*, and a connecting portion 123*b* for completing a connection to a circuit in an adjoining car. Connection portion 123*b* may be disposed between or in portions 304*a*, 304*b*. Portions 304*a*, 304*b* may comprise separate pieces joined by a fastener 333 or any other suitable method, or may comprise parts of a single piece. As shown in FIG. 5, conductor 122 may comprise separate resilient fingers 335*a*, 335*b*, each configured as described above for coupling 100. In an embodiment of the invention, resilient fingers 335*a*, 335*b* may comprise appendages of a common conductor 122. In this embodiment, two or more resilient fingers provide the advantage of redundancy in making an electrical connection to contact 103*b*. In the alternative, each finger may be connected to a separate conductor and may be used to connect separate circuits in the manner described above for coupler 200.

Blocks 337, 338 may comprise essentially decorative or optional structural components that are not of particular significance to the invention described herein. In the alternative, these blocks may be used to house desired electronic or magnetic components for any purpose disclosed herein (e.g., making an infrared connection between cars), or for any other purpose known in the art. Other details of coupling 300 may be as described elsewhere herein, or may be adapted as desired by one of ordinary skill.

FIGS. 7–10 show an alternative embodiment of an integrated mechanical/electrical coupling, designated 400. Coupling 400 is of an interlocking C-shape type, and embodies the same principles as the first and second embodiments, namely, of couplings 100 and 200. An inter-engaging proximal portion of the coupling is shown. Distal portions of the coupling (i.e., portions adjoining the cars) are not shown, and may be configured in any suitable manner. Coupling 400 may comprise C-shaped first and second coupling members 402 and 404 interlocked in an engaged position. First coupling member 402 may comprise a first electrically conducting material 418 disposed on a portion of the surface of first coupling member 402. Coupling member 402 may also comprise a first layer of insulating material 420 disposed between the surface of coupling member 402 and conductive material 418. Similarly, coupling member 404 comprises a second layer of conductive material 422 disposed on a portion of the surface of coupling member 404. Coupling member 404 may also include a second layer of insulating material 424 disposed between the surface of coupling member 404 and conductive layer 422.

Conductors 418 and 422 are depicted in a horizontal orientation in the region between coupling members 402, 404. In the alternative, the conductors may be oriented vertically in this region, as in couplings 100 and 200 described above, or in some orientation intermediate between horizontal and vertical. Yet another alternative may provide contact elements between the coupling members that are circularly symmetrical in their plane of operation, and thus, present the same geometry regardless of orientation. Whatever the orientation of the contacts, at least one contact of either member 402 or 404 should comprise a resilient contact that is configured to be biased against an opposing contact on the opposite coupling member, when the couplings members are engaged. Contacts may be connected to circuits in adjoining cars in a manner similar to that described above for coupling 100.

Figure 7:
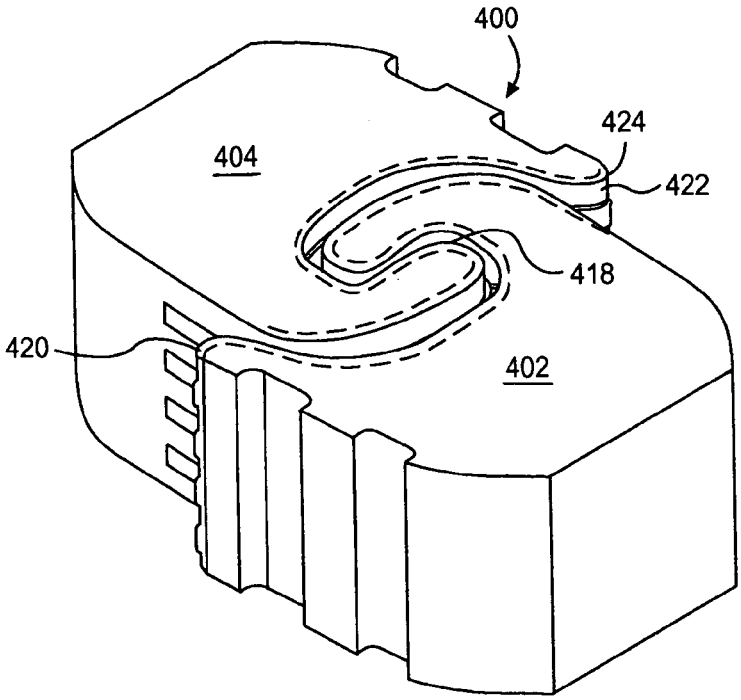
FIG. 7 is a first perspective view of an alternative embodiment of an integrated mechanical/electrical coupling in accordance with the present invention.
Figure 8:
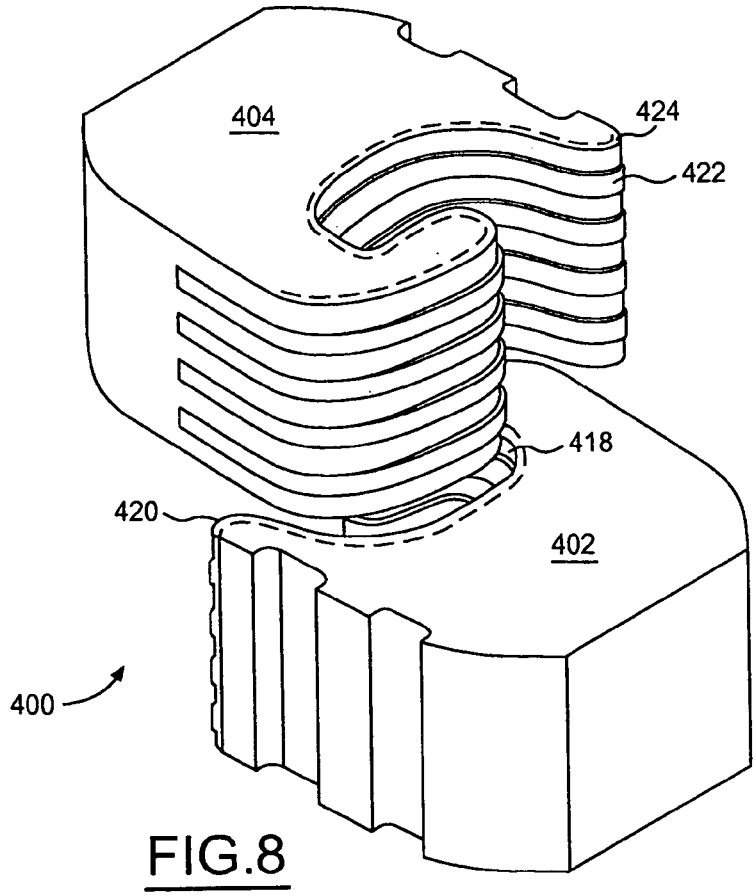
FIG. 8 is a second perspective view of the integrated mechanical/electrical coupling of FIG. 7.
Figure 9:
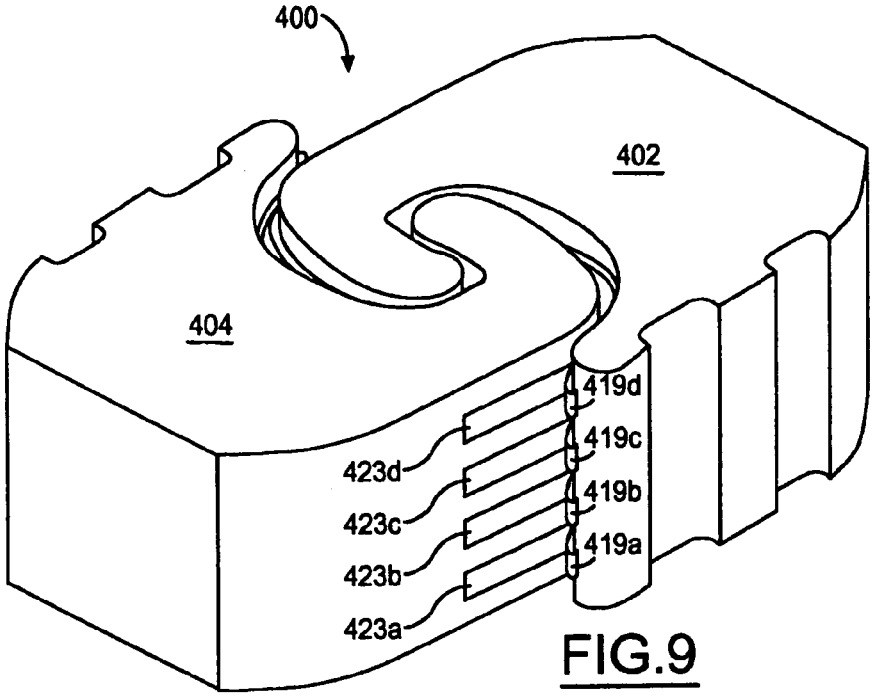
FIG. 9 is a third perspective view of the integrated mechanical/electrical coupling of FIG. 7.
Figure 10:
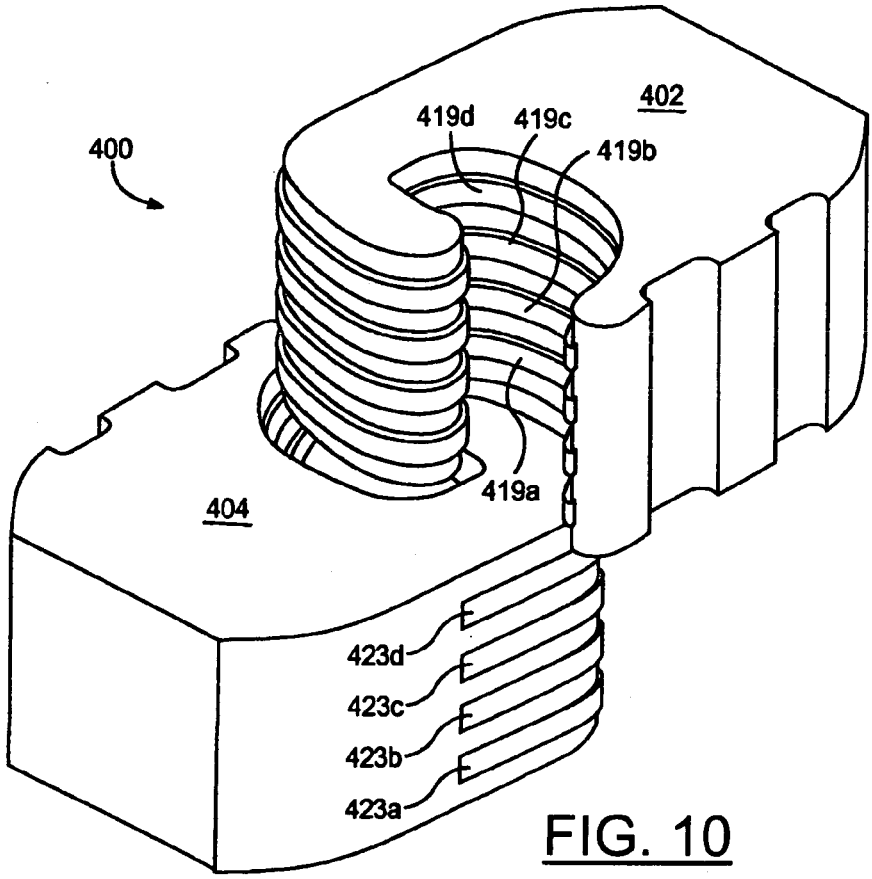
FIG. 10 is a fourth perspective view of the integrated mechanical/electrical coupling of FIG. 7.

As shown in FIGS. 8 and 10, first and second coupling members 402 and 404 may be disengaged by vertical displacement. When coupling members 402 and 404 are disengaged, their corresponding train cars are neither mechanically nor electrically coupled together. However, as shown in FIGS. 7 and 9, when coupling members 402 and 404 are interlocked so as to be engaged with each other, adjacent cars may be both mechanically and electrically connected without the necessity of additional wiring or other coupling mechanisms.

Conductors 418 and 422 of coupling 400 may also be configured with a plurality of electrically conducting elements. A four-conducting element configuration is shown, but any other number of conductors may also be suitable. Conductive elements 419*a* through 419*b* are in engagement with a corresponding plurality of conductive portions 423*a* through 423*b* when first and second coupling portions 402 and 404 are engaged. This arrangement may be used to connect any number of individual electric circuits between coupled train cars. In each of the foregoing embodiments, each of the plurality of conductive elements in first and second layers of conductive material 418 and 422 may be separated from each other to provide distinct electrical circuits. In addition, intervening portions of electrically insulating material may be disposed in between electrical elements.

Accordingly, with respect to FIGS. 1–10, an integrated mechanical/electrical coupling in accordance with the present invention includes a first and second coupling member attached to a first and second train car, respectively. A first conductive material may be supported by the first coupling member, and a second conductive material may be associated with the second coupling member. In the alternative, either or both coupling members may comprise a corresponding one of the first and second conductive materials. When the first and second coupling members are placed in engagement, the first and second conductive materials also engage via a resilient contact disposed at mating engagement portions of the coupling members, thereby creating both a mechanical and electrical connection between the first and second train cars with a single coupling mechanism.

Figure 11:
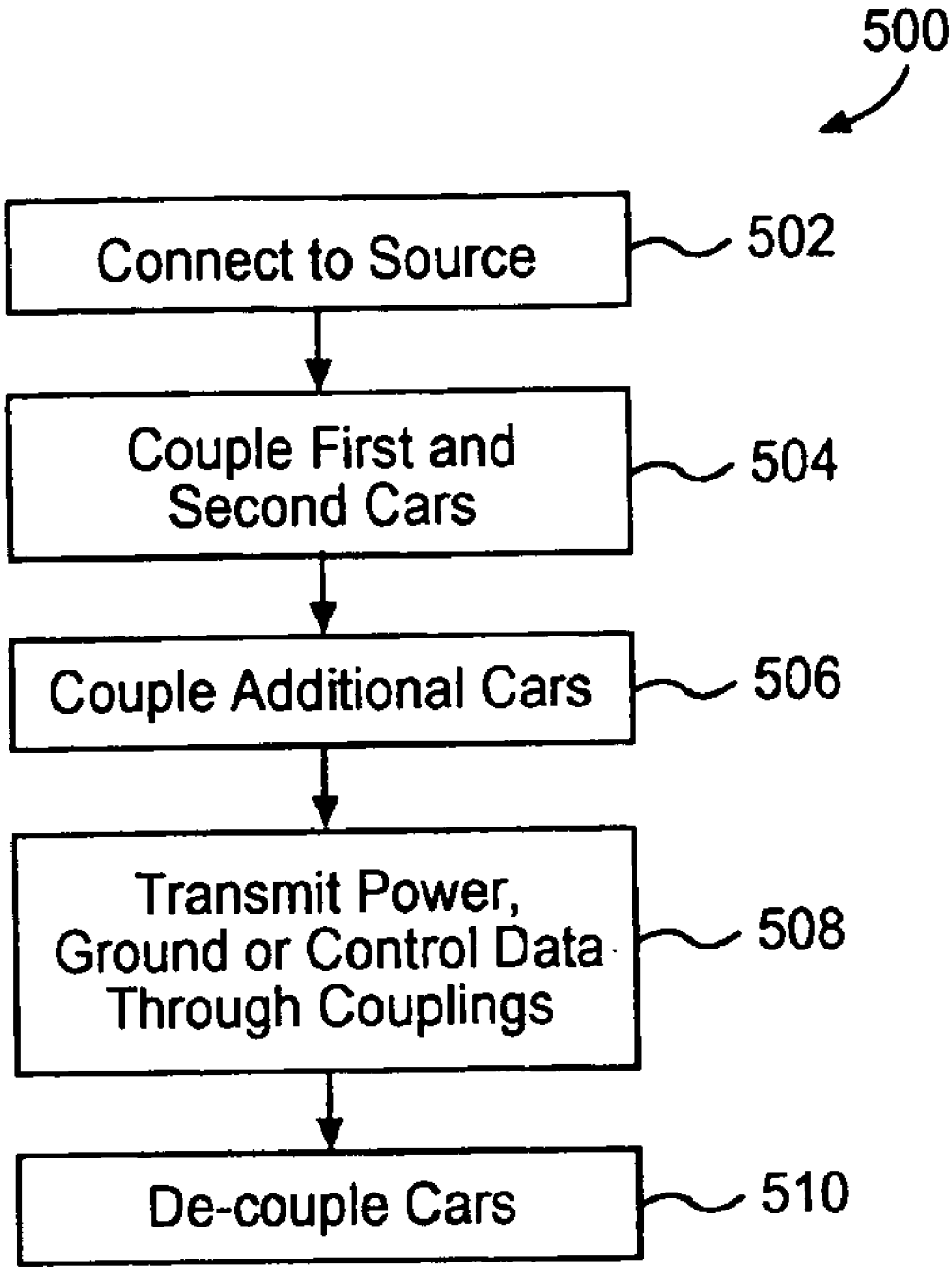
FIG. 11 is a flow diagram showing exemplary steps of a method of operating an electric train in accordance with the present invention.

With respect to FIG. 11, a method 500 of powering an electric train is shown. Step 502 comprises connecting to a source of power, ground, control signals, or data signals. For example, wheels of a first car may maintain a rolling connection to a rail of a model train track supplying power, ground, or DC offset control signals. For further example, a wireless receiver in a first car may receive control or data signals transmitted by a control unit, such as by using a near-field transmission radiated from the model track or a short-range transmission broadcast from a base station or control unit. The first car should be equipped with an integrated mechanical/electrical coupling as described herein, and one or more contacts in the coupling should be connected to the power, ground, control, or data circuit in the first car.

At step 504, the first car is coupled to a second car. The second car should comprise a circuit for receiving the power, ground, control, or data signal from the first car. The second car should further comprise an integrated coupling having a coupling mechanism and one or more contacts complementary to the coupling mechanism and one or more contacts of the first car. Coupling may be accomplished using any method as known in the art. Than is, with such couplers, mechanically coupling the cars maybe accomplished in the same way as prior art mechanical couplers. The first and second cars may thus be coupled without a need for additional steps to establish an electrical connection between them. Once coupled, power, ground, control or data signals may be communicated between the first and second cars via one or more resilient contacts of the integrated coupling.

At step 506, any number of additional cars may be connected to the first or second car to form a longer train. If desired, additional cars may be connected to the first or second car or to one another using an integrated mechanical/electrical coupling as described herein. Power, ground, control or data signals may thus be provided between any desired number of connected cars.

At step 508, the train may be operated on the model track. Circuits in one or more connected cars may be powered or controlled via power or signals passing through the inventive couplings. For example, a single receiver in a locomotive or tender unit may be used to receive control signals that are then distributed to the entire train via the couplings. In the alternative, or in addition, wheels of an adjacent car (such as a tender) may be used to provide or enhance rolling connections to the rails for power, ground, or control signals provided to a locomotive or other car. Another application may comprise signaling data between cars. For example, when a freight car has moved into position at a model freight terminal or loading accessory, a sensor, such as a switch, may be triggered in the freight car. A signal from the sensor may be communicated through one or more cars and inventive couplings to the locomotive, which upon receiving the signal may automatically stop the train in position. Similarly, the locomotive may automatically start or reverse the train in response to signals received from trailing cars. One of ordinary skill may devise other applications for inter-car communication, power distribution, or ground connections.

When operation of the train is completed, any desired number of cars may be decoupled at step 510. Decoupling may comprise the reverse of coupling. Advantageously, the ease with which cars may be coupled and decoupled may increase hobbyists' enjoyment and satisfaction in assembling trains using a variety of different cars.

Having thus described a preferred embodiment of an integrated mechanical/electrical coupling for a model train, it should be apparent to those skilled in the art that certain advantages of the within system have been achieved. It should also be appreciated that various modifications, adaptations, and alternative embodiments thereof may be made within the scope and spirit of the present invention. For example, particular configurations of mechanical couplers, resilient contacts, and other components of a coupling have been illustrated, but it should be apparent that the inventive concepts described above would be equally applicable to other configurations of integrated mechanical/electrical coupling for a model train. The invention is defined by the following claims.

What is claimed is:

1. A connector to be used in a model train, comprising:

a first coupling member having a distal portion configured to attach to a first model train car;

a second coupling member having a distal portion configured to attach to a second model train car, and a proximal portion configured to engage with a proximal portion of the first coupling member; and a resilient electrical contact associated with the second coupling member and disposed to make an electrical connection to a first electrical contact of the first coupling member when the proximal portion of the second coupling member is engaged with the proximal portion of the first coupling member.

2. The connector of claim 1, further comprising a first electrical conductor connected to the first electrical contact and extending to the distal portion of the first coupling member.

3. The connector of claim 1, wherein the first electrical contact comprises a substantially rigid end disposed against the resilient electrical contact when the proximal portion of the second coupling member is engaged with the proximal portion of the first coupling member.

4. The connector of claim 1, wherein the proximal portion of the second coupling member and the proximal portion of the first coupling member are configured to permit vertical movement of the first coupling member relative to the second coupling member when engaged together.

5. The connector of claim 1, wherein the resilient electrical contract comprises at least one vertically-oriented finger extending from a surface of the second coupling member.

6. The connector of claim 1, wherein the resilient electrical contact comprises a plurality of vertically-oriented fingers extending from a surface of the second coupling member.

7. The connector of claim 1, wherein the resilient electrical contact comprises a piece of metallic sheet material.

8. The connector of claim 1, further comprising a first model car and a second model car coupled together by the first and second coupling members, whereby the first model car is in electrical communication with the second model car.

9. The model train assembly of claim 1, further comprising a wireless transmitter associated with one of the first or second model train cars, the transmitter disposed to communicate with a wireless receiver associated with another of the first or second model train cars only when the proximal portion of the second coupling member is engaged with the proximal portion of the first coupling member.

10. The connector of claim 2, wherein the first electrical conductor is substantially surrounded by at least one layer of insulating material.

11. The connector of claim 2, further comprising a second electrical conductor connected to the resilient electrical contact and extending to the distal portion of the second coupling member.

12. The connector of claim 11, wherein the second electrical conductor is substantially surrounded by at least one layer of insulating material.

13. The connector of claim 4, wherein the resilient electrical contact and the first electrical contact are configured to maintain an electrical connection during the permitted vertical movement.

14. The connector of claim 13, wherein the resilient electrical contact is configured to remain resiliently biased against the first electrical contact while sliding vertically during the permitted vertical movement.

15. The connector of claim 5, wherein the at least one finger is curved in a substantially vertical plane to define an intermediate portion for contacting the first electrical contact between a base of the at least one finger and an end of the at least one finger.

16. The connector of claim 2, wherein the second electrical conductor and the resilient electrical contact comprise an integrated piece of metallic sheet material.

17. The connector of claim 16, wherein the integrated piece of metallic sheet material is shaped to conform to the second coupling member.

18. The connector of claim 10, wherein the first electrical conductor and the first electrical contact comprise an integrated piece of metallic sheet material.

19. The connector of claim 10, wherein the first electrical conductor comprises a mechanical draw bar.

* * * * *